US005997100A

United States Patent [19]

Marshall et al.

[11] Patent Number: 5,997,100

[45] **Date of Patent: *Dec. 7, 1999**

[54] INERTIZATION SYSTEM FOR HIGHWALL MINING

[75] Inventors: Gordon Alexander Marshall, Camberwell; Geoffrey Raymond Rigby, Charlestown, both of Australia

[73] Assignee: The Broken Hill Proprietary Company Limited, Melbourne, Australia

[ * ] Notice: This patent is subject to a terminal disclaimer.

[21] Appl. No.: 09/168,895

[22] Filed: Oct. 9, 1998

Related U.S. Application Data

[62] Division of application No. 08/591,477, filed as application No. PCT/AU94/00385, Jul. 12, 1994, Pat. No. 5,820,223.

[30] Foreign Application Priority Data

| | | | |
|---|---|---|---|
| Jul. 12, 1993 | [AU] | Australia | PL9888 |
| Apr. 14, 1994 | [AU] | Australia | PM5081 |

[51] Int. Cl.[6] ..... E21F 5/00

[52] U.S. Cl. ..... 299/12; 299/64

[58] Field of Search ..... 299/12, 64, 1.4

[56] References Cited

U.S. PATENT DOCUMENTS

| | | | |
|---|---|---|---|
| 3,922,015 | 11/1975 | Poundstone | 299/12 X |
| 4,465,155 | 8/1984 | Collins | 299/1.4 |
| 5,253,925 | 10/1993 | Modzik, Jr. | 299/12 |
| 5,261,729 | 11/1993 | Addington et al. | 299/64 |
| 5,273,344 | 12/1993 | Volkwein et al. | 299/12 |
| 5,820,233 | 10/1998 | Marshall et al. | 299/12 |

*Primary Examiner*—David Bagnell
*Assistant Examiner*—Sunil Singh
*Attorney, Agent, or Firm*—Larson & Taylor

[57] ABSTRACT

A highwall mining system for mining aggregate material from a seam (8) includes a mining device (9) for cutting aggregate material from the seam (8) thereby to form a drive (10) in the seam (8), a conveying device (11) for conveying mined aggregate material from the drive (10), and a circulation device located on or in the region of the mining device (9) for circulating the atmosphere at least at the forward end of the drive (10). The system further includes an inertization device (60, 61, 63, 71) for maintaining the concentration of oxygen in the atmosphere in the drive (10) lower than the concentration of oxygen required for explosion of methane gas and/or dusts and/or other flammable materials in the drive (10).

22 Claims, 3 Drawing Sheets

INERTIZATION SYSTEM FOR HIGHWALL MINING

This is a division of application Ser. No. 08/591,477 filed Apr. 1, 1996, now U.S. Pat. No. 5,820,223 which is a national stage of PCT/AU94/00385 filed Jul. 12, 1994.

The present invention relates to highwall mining of a seam of aggregate material.

In particular, the present invention relates to a highwall mining system of the type which comprises:

(a) a mining means for cutting aggregate material from a seam to thereby form a drive in the seam, (b) a conveying means for conveying mined aggregate material from the drive; and (c) a circulation means located on or in the region of the mining means for circulating the atmosphere at least at the forward end of the drive.

The highwall mining system of the present invention is suitable particularly, although by no means exclusively, for mining coal from a seam extending from an exposed face in a high wall of an open cut mine.

Highwall mining of coal offers the potential for low cost recovery of coal that cannot normally be recovered economically by conventional surface or underground mining operations.

One of the areas of concern for highwall mining of coal, especially as the penetration depth of drives increases, is the possibility of explosions resulting from methane and/or other gases seeping into drives and/or coal dust generated in the process of mining coal.

Explosions have occurred in U.S. highwall mining operations, resulting in injuries, and thus there is considerable incentive to develop a highwall mining system which can avoid explosions.

The explosive limits for methane in air are in the range of 5 to 15%. As the oxygen concentration in the gas mixture decreases (from 21% present in air), the explosive range of methane concentrations reduces and at an oxygen concentration below 12.2% (at ambient temperatures) an explosion with methane cannot occur.

Conventional underground mining operations require that ventilation be provided to dilute exhaust explosive gases and that methane levels be monitored. Specifically, in conventional underground mining operations, if methane levels reach 1.25% an alarm sounds and all power is shut off and if methane levels reach 2.5% the mine must be evacuated. However, in a highwall mining operation, where ventilation of a drive is not required, methane concentrations could reach or exceed explosive limits in air without difficulty.

There is only very limited publicly available information on the explosive limits of hybrid mixtures containing methane and coal dust in air or in atmospheres with oxygen concentration less than 21%. Nevertheless, on the basis of research work carried out for the applicant it appears that at oxygen concentrations below 9% an explosion with hybrid mixtures containing methane and coal dust can not occur. This research work was conducted using coal samples representing one Queensland mine where highwall mining is proposed. Similar work is needed to confirm the result for coal types found in other mines.

An object of the present invention is to provide a highwall mining system of the type described above in subparagraphs (a) and (b) which avoids explosions caused by ignition of methane gas and/or coal dust and/or other flammable materials in a drive.

According to the present invention there is provided a highwall mining system for mining aggregate material from a seam comprising:

(a) a mining means for cutting aggregate material from the seam and thereby forming a drive in the seam;

(b) a conveying means for conveying mined aggregate material from the drive;

(c) a circulation means located on or in the region of the mining means for circulating the atmosphere at least at the forward end of the drive; and (d) an inertization means for maintaining the concentration of oxygen in the atmosphere in the drive lower the concentration of oxygen required for explosion of methane gas and/or dusts and/or other flammable materials in the drive, the inertization means comprising:

(i) an inertization gas injection means for injecting an inertization gas into the drive, the inertization gas injection means having an outlet for inertization gas located during the early stages of forming the drive on or in the region of the mining means and, thereafter, on or in the region of the mining means and/or at the entrance of the drive and/or between the entrance of the drive and the mining means; and (ii) a barrier means to restrict gas flow into and from the drive.

The present invention is the consequence of experimental work carried out by the applicant which showed unexpectedly that, in the absence of an effective barrier to restrict gas flow into and from a drive, a stratified gas recirculation flow is set up by a circulation fan of a continuous miner which has the effect of inducing external air flow into the drive along the bottom of the drive and exhausting gas flow from the drive along the top of the drive.

The experimental work also showed that external wind gusts cause turbulence at the entrance of a drive which, in turn, cause an unexpected significant destabilizing effect on the air flow pattern in the vicinity of the entrance and the first 50–60 meters of the drive, including in some instances the induction of significant amounts of air into the drive.

The net result of the foregoing results of the experimental work is that, in the absence of an effective barrier to restrict the entrance of a drive, there would be a significant increase in the likelihood of unsafe oxygen concentrations being developed in a drive, especially in the first 50–60 meters i.e. in the early stages of forming the drive.

The term "inertization gas" understood to means a gas that contains either no oxygen or a concentration of oxygen that is low enough to maintain the concentration of oxygen in the drive below that required for explosion of methane gas and/or dusts and/or other flammable materials in a drive.

It is preferred that the inertization gas injection means be adapted to inject into the drive a volume of inertization gas that is greater than the volume of aggregate material mined from the drive so as to slightly pressurize the drive there to create an outward flow of gas from the drive.

It is noted that it may be possible to substantially reduce the volume of inertization gas injected if significant quantities of methane and other gases are released from the coal during mining.

It is preferred that the inertization gas injection means comprises a plurality of outlets at the drive entry and/or at spaced intervals along the drive.

It is preferred particularly that the inertization gas injection means further comprises a control means for selectively regulating the volumetric flow rate of the inertization gas through each outlet.

It is preferred that the inertization gas be selected from one or more of, inert combustion gases, methane, and nitrogen, and mixtures of two or more such gases.

It is understood herein that the term "nitrogen" includes within its scope gases which are substantially nitrogen (typically 95% or more) and contain small amounts of other gases such as oxygen and argon.

It is preferred particularly that the inertization gas be nitrogen.

In that event, it is preferred that the inertization gas injection means comprises, a means for generating nitrogen outside the drive, and a conduit means for transferring the nitrogen into the drive.

It is preferred particularly that the means for generating nitrogen be a pressure swing adsorption means.

It is preferred that the barrier means be located at the entrance of the drive.

It is preferred particularly that there be a plurality of the barrier means along the length of the drive.

It is preferred that the concentrations of oxygen and/or methane and/or other flammable gases in the drive be sampled on the mining means and/or at the drive entry and/or along the drive by sensors in the drive and/or at the entry, and/or externally via a tube bundle located in the drive for extracting gas samples from the drive.

It is preferred that sensors in the drive to measure the concentration of oxygen be of the chemical cell and/or zirconia limiting current and/or infra-red types.

It is preferred that tho concentrations of oxygen in the gases extracted via the tube bundle be measured by sensors of the paramagnetic type.

It is preferred that the concentration of oxygen in the drive be sampled in order to monitor and control the concentration of oxygen in the drive and the injection of the inertization gas.

On the basis that an explosion in hybrid mixtures containing methane and coal dust will not occur in concentrations of oxygen below 9%, it is preferred to inject inertization gas to maintain the oxygen level in the drive at or below 5% and to stop mining if the open level reaches or exceeds 7%.

It is preferred that the mining means be remotely controlled from outside the drive.

It is preferred that the mining means be a continuous miner of the type comprising, a plurality of cutting picks on a rotatable cutting drum mounted on the end of a boom that is supported for pivotal movement about a horizontal axis.

It is preferred that the mining means comprise water sprays and a dust scrubber or other means for removing dust from the atmosphere in the drive. The water-sprayed from the miner may also contain surfactants or other chemical additives for removing dust in the atmosphere in the drive.

It is preferred that the circulation means be a fan.

It is preferred particularly that the fan be associated with the dust scrubber.

It is preferred that the circulation fan be adjustable to vary the volume of air or gas passed through the dust scrubber in discrete steps and/or infinitely thereby to selectively control the atmosphere in the drive in the region of the mining means.

It is preferred particularly that the circulation fan be arranged to direct air or gas through the dust scrubber.

It is preferred that the system further comprises a plurality of the circulation means located at spaced intervals along the conveying means to mix the outwardly and inwardly flowing gases in the drive to avoid localized build-up of gases and/or dusts in the drive.

It is preferred that the conveying means comprise a plurality of modular conveyor units releasably coupled together and to the mining means.

The coupling means for the modular conveyor units may be of any suitable form such as the couplings described in Australian provisional applications PL9888 and PM5081 from which the subject International application claims priority and in Australian provisional application PM5380 of the applicant and the disclosure in these provisional applications is disclosed herein by cross-reference.

By way of example, each of the modular conveyor units and the mining means may comprise a semi-rigid coupling for releasably coupling together the conveyor units and the mining means.

The term "semi-rigid coupling" is understood herein to mean a coupling which allows a pushing force to be transferred from conveyor unit to conveyor unit along the length of the conveying to move the conveying means forward without jackknifing or buckling the conveyor units while allowing angular displacement in a vertical plane to allow the conveying means to follow the contours of the drive and to transfer a controlled pushing force on to the back of the mining means to increase or provide the "sumping" forces for the cutting and mining of aggregate material.

It is preferred that the semi-rigid coupling between the conveyor unit and the mining means have minimum free-play in the general longitudinal direction of the conveying means and the mining means and hence the direction of advance. The minimizing of free-play is considered to be advisable to control the position and straight alignment of the conveying means and the mining means and to control the forces acting on and in them. For example, the axial force wit the conveying means may change from tension to compression or from compression to tension in the course of excavation of one drive due to changes in the seam include angle, the number of conveyor units used, and/or the mining means operation, such as from "sumping" to "shearing".

It is preferred that each conveyor unit comprise a wheel assembly.

It is preferred that each conveyor unit comprise a belt or a chain conveyor.

It is preferred that the highwall mining system comprise a launch platform adapted to be positioned at the entrance to the drive and that the launch platform comprises:

(a) a launch platform conveyor for receiving and discharging aggregate material from the end of the conveying means; and (b) a driving means for pushing the mining means and the conveying means into the seam to form the drive and for pulling the mining means and the conveying means from the drive.

It is preferred that the launch platform conveyor be a belly conveyor.

The driving means for pushing/pulling the mining mean and the conveying means may comprise two sets of tandem drive cylinders, each set having one drive cylinder on each side of the conveying means, and the drive cylinders on each side of the conveying means being longitudinally aligned and spaced apart.

It is preferred that the two sets of drive cylinders act co-operatively an a "walking" system to advance by pushing, and to withdraw by pulling, the mining means and the conveying means. With such an arrangement, during advance into the seam, and similarly on withdrawal from the seam, the two sets of drive cylinders act cyclically so that one set retracts while the other set controls the advance rate of the mining means and the is conveying means.

Alternatively, the driving means for pushing/pulling the mining means and the conveying means may comprise a set of reciprocating drive cylinders and/or sets of linear tracks, linear and/or rotary drives, chains, cables or other mechanical devices driven by electric or hydraulic means.

Additional embodiments of the driving means are disclosed in Australian provisional application PM5380 of the applicant.

It is preferred that the launch platform comprise an anchoring means to releasably anchor the launch platform against the pit floor and/or the highwall to react against pushing and pulling forces generated on the launch platform.

The anchoring means may comprise:

(a) grouser plates supporting the base of the launch platform;

(b) ground engaging pins on the launch platform; and (c) means of reacting back into the highwall at its toe and above the seam.

It is preferred that the launch platform comprise an extensible and/or removable front for providing a supporting structure for the mining and the conveying means between the launch platform and the drive entry.

It is preferred that the highwall mining system further comprise a means for adding conveyor units to the conveyor train.

In this connection, it is preferred that the launch platform further comprise, a guide track for guiding additional conveyor units in turn to the end of the conveying means and into the drive, and delivery/discharge platform on opposite sides of the guide track for storing conveyor units prior to addition to or after removal from the conveying means.

It is preferred particularly that the delivery/discharge platform prevent uncontrolled movement of the conveyor units while supporting said conveyor units. As a consequence, it may be possible to stack more than one conveyor unit on each of the delivery/discharge platforms.

It is preferred that the conveyor unit addition means comprise an overhead crane or other suitable means mounted on the launch platform for selectively transferring conveyor units from the delivery/discharge platforms to the end of the conveying means and from the end of the conveying means to the delivery/discharge platforms.

It is preferred that the overhead crane, or other suitable means, has sufficient rigidity to prevent uncontrolled movement of the conveyor units while being handled by the crane.

It is preferred that the launch platform be adapted to receive delivery or discharge of conveyor units from either side of the launch platform conveyor and comprise a means for preventing uncontrolled movement of the conveyor units not coupled to the conveying means but supported by the launch platform.

It is preferred that the highwall mining system further comprise a loading/unloading machine for transferring conveyor units between the launch platform and the pit area.

It is preferred particularly that the loading/unloading machine be a wheeled or tracked machine with a loading head for lifting and engaging the conveyor units in such a manner as to prevent uncontrolled movement of one or more conveyor units while being handled by the machine.

In addition, it is preferred that the loading head be adjustable to tilt longitudinally and/or transversely and/or rotate about a horizontal and/or a vertical axis to handle the conveyor units. These loading head motions are particularly desirable where the loading/unloading machine is operating on a different inclined angle to the inclined angle of the launch platform.

It is preferred that the launch platform comprise safety hand rails or fences or other safety devices along both sides of the launch platform conveyor.

It is preferred particularly that the hand rails or fences have openings or moving sections, such as sliding gates, to allow access for the loading/unloading of the conveyor units over the belly conveyor directly by the loading machine or other means.

As is described briefly previously, the present invention is the consequence of experimental work carried out by the applicant on a highwall mining system of the type comprising:

(a) a mining means for cutting aggregate material from a seam to thereby form a drive in the seam, with the mining means including a circulation fan for circulating the atmosphere in the drive around the mining means; and (b) a conveying means for conveying mined aggregate material from the drive.

The experimental work included mathematical modelling using a HARWELL-FLOW 3D computational fluid, dynamics (CFD) package based on the solution of the Navier Stokes equations for turbulent flow.

A summary of the findings of the mathematical selling in situations where a highwall mining system of the type described above is operating in a drive with an open entrance is set out below.

(a) The circulation fan has a major effect on circulation within and induced flow of air into the drive, especially in the first 50–60 meters of the drive, with the consequence that unsafe oxygen concentrations are likely to be experienced unless the influx can be reduced significantly.

(b) A reduction in circulation fan discharge velocity reduces the air inflow (approximately in a linear fashion) although lower velocities also reduce the circulation from the working face and hence the efficiency of coal dust removal by the gas scrubber.

(c) The effects in (a) and (b) are very much reduced as the length of the drive increases.

(d) The conveying means has a minimal effect on the flow patters and velocities in the vicinity of the mining means but induces higher velocities (compared to an empty drive) at the entrance. Induced air velocities around 0.1 m/s may be produced over approximately one half of the drive cross section.

(e) The variation in flow patterns and velocities within the drive indicate that significant variations in gas composition at different locations could be expected.

The experimental work also included experimental work on a half-size physical model of a preferred embodiment of the highwall mining system.

The drive was constructed from external plywood with a polycarbonate side wall to allow visual observations. One end was sealed with plywood and the other end was left open with provision to fit various types of barriers. The internal dimensions of the drive were 1.75 m×1.75 m and the overall length was 15 m.

A half-scale wooden mock-up of a continuous miner and a conveyor train were constructed and positioned in the drive to allow effective simulation of gas flow patterns.

A centrifugal fan was fitted to the miner to simulate the circulation pattern that would be established by an air circulation fan for a dust scrubber on an operational continuous miner.

The fan motor was fitted with an electronic variable speed controller to allow a full range of fan discharge velocities to be readily achieved. A transition section and flexible 250 mm diameter flexible outlet was provided so that the discharge orientation could be easily changed. The capacity of the fan was chosen to allow a maximum discharge velocity of approximately 5 m/s (corresponding to 10 m/s in the full scale operation) to be achieved.

A 200 mm diameter flexible hose connected to the fan inlet and an opening (50 mm wide×900 mm long) close to the underside of the circular "cutter head" was used to simulate the collection of the dust-laden inlet gas stream to a water scrubber. A 330 mm wide conveyor, 7 m long, operating at a speed of 0.9 m/s, was used to simulate the effect of the conveyor belt on the gas circulation patterns.

In one test, additional air was added to simulate the effect of methane release in the drive or an excess nitrogen flow over that required to replace the void volume removed by the coal. In this case, a measured air flow was introduced in the vicinity of the top of the "cutter head" through a flexible 125 mm diameter hose.

The simulation conditions for the half-size model were based on maintaining similar gas residence times and flow, or mixing lengths, to those in a typical full scale operation. This meant that for the half-size model (all lengths halved), the scrubber gas discharge velocity (and area of outlet) was halved to give approximately the same flow path length (say between the fan exit and the top of the drive) and residence time, as the full scale unit. Under these conditions, the volume (and volumetric flow rate) were ⅛ that of the full scale values. This also meant that the model length was half that of the full size unit (i.e. 15 m compared to 30 m in this case).

A theatrical fog generator (utilising a solution containing butylene glycol, propylene glycol and triethylene glycol) was used to generate a steady stream of smoke which was injected into the same suction inlet (or appropriate position) for the flow visualization trials.

To examine the effects of a "sealed" entrance, two forms of barrier were evaluated. The first barrier comprised a sheet of clear polycarbonate fixed to the opening and the second barrier an air curtain in the opening.

The experimental work on the half-size physical model confirmed the results of the mathematical modelling.

Specifically, it was found that with an open entrance there was an outward flow of air along the top of the drive over approximately ⅓ to ½ of the area with a corresponding inward induced air flow along the bottom of the drive and a local recirculating flow around the miner.

In addition, it was found that turbulence at the of the drive caused by external wind gusts could have a a significant impact on the gas flow pattern in the vicinity of the entrance.

The experimental work on the half-size physical model also established that, with a "sealed" entrance, there was essentially uniform mixing within the drive over the entire length. The stratified pattern set up with the open entrance was completely absent. Similar observations were made with the belt conveyor in position.

Based on the above observations of gas flow patterns in the half-size physical model it is clear that an operational high wall mining system provision should be made:

(a) to seal or at least restrict the entrance of the drive by means of a suitable form of barrier; and (b) to inject an inertization gas in the vicinity of the miner (especially for the first 50 m–60 m of the drive) to ensure that the void volume created by the aggregate material discharge is filled with inertization gas and to ensure that induced air flow into the drive is kept at a minimum so that the concentration of oxygen in the drive is less than the explosive limits for hybrid mixtures of methane and coal dust.

In this connection with regard to (b) above, based on observations of gas flow patterns in the half-size physical model, it is clear that injection of inertization gas near the entrance of the drive on its own could result in by-passing of a substantial amount of inertization gas back out of the drive, especially when aggregate material is not being discharged on the conveying means.

Furthermore, based on the observations of gas flow patterns in the half-sized physical model, as the depth of penetration increases, the influence of the gas circulation fan of the miner in inducing air into the drive should become less significant. Therefore, it may be possible to reduce inertization gas flows or to inject the inertization gas partway along the drive as the penetration depth increases.

As is discussed above, nitrogen is a particularly preferred inertization gas.

In this connection, nitrogen can be readily generated on-site using either pressure swing adsorption (PSA) or polymeric semi-permeable membrane systems. Self contained generators utilising both technologies are available for the gas flow required. Membrane systems are lighter and more compact than the PSA system, but the PSA systems are currently more reliable and cost effective.

PSA system separate nitrogen from compressed air by passing the air through a dual vessel configuration containing pelletised carbon molecular sieve (CMS) material. As the air passes through the first bed, the CMS adsorbs the oxygen, allowing the nitrogen to pass through. When this bed approaches saturation, it switches to a regenerative phase (where the pressure is released and the oxygen desorbs) while the second bed automatically begins the separation process. Product nitrogen purity can be varied to suit the particular process requirements.

Membrane systems make use of the difference in gas permabilities for oxygen and nitrogen through semi-permeable polymeric membranes to generate either nitrogen or oxygen enriched air. The compressed air feed system is basically the same as that used for the PSA system.

The present invention is described in more detail with reference to the accompanying drawings, in which.

Figure 1:
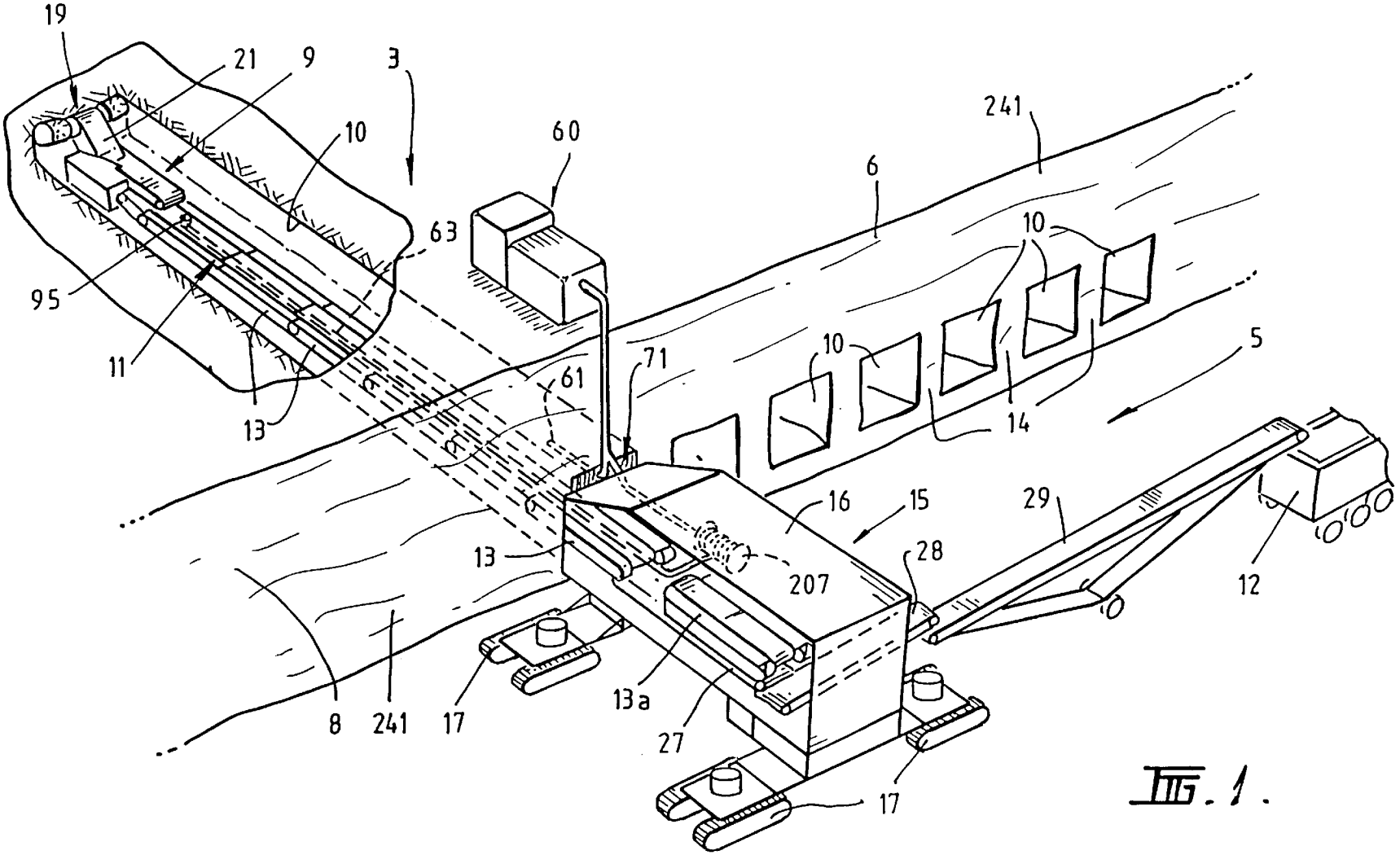
FIG. 1 is a perspective view, largely in diagrammatic form, of the mining means, the conveying means, the launch platform (with substantial detail omitted), and the inertization means of a preferred embodiment of a highwall mining system in accordance with the present invention located in an open cut mine for mining a drive in a seam in a highwall of the mine.

With reference to FIG. 1, the highwall mining system, generally identified by the numeral 3, is positioned in an open cut mine 5 to cut coal from a coal seam 8 extending from the exposed face of the highwall 6 of the mine 5.

The basic components of the highwall mining system 3 are:

(a) a mining means 9 for cutting coal from the seam to form a drive 10 in the seam 8;

(b) a conveying means 11 formed from a plurality of conveyor units 13 releasably coupled together for conveying coal from the drive 10;

(c) a launch platform 15 located at the entrance to the drive 10 for adding new conveyor units 13*a* to the conveying means 11 and for discharging coal from the drive 10 into a surge bin or truck 12 for transportation from the mine 5;

(d) a combined driving/controlling means (not shown in FIG. 1) located on the launch platform 15 for driving the mining means 9 and the conveying means 13 into the seam 8 and thereafter for withdrawing the mining means 9 and the conveying means from the drive 10 in a controlled manner without there being any uncontrolled movement of the mining means 9 and the conveying means 11 in response to the incline of the seam 8 and/or during the addition of a new conveyor unit 13*a* to the conveying means 11; and (e) an inertization means for maintaining the concentration of oxygen in the atmosphere in the drive 10 lower than the concentration of oxygen required for explosion of methane and/or dusts and/or other flammable materials in the drive 10.

The launch platform 15 is mounted on an assembly of caterpillar tracks 17 and is movable along the exposed face 241 of the highwall 6 so that the highwall mining system 3 can form a plurality of drives 10 in the seam 8 which are separated by support pillars 14 of unmined material.

The mining means 9 is of conventional configuration and comprises a track-mounted continuous miner having a plurality of cutting picks (not shown) on a rotatable cutting drum 19 (which typically comprises 3 separate segments) mounted on the end of a boom 21 that is supported for pivotal movement about a horizontal axis.

The mining means 9 further comprises water sprays 101 and a dust scrubber 102 for removing dust from the atmosphere in the drive 10. The dust scrubber includes a fan 103 acting as a circulating means for circulating the atmosphere through the dust scrubber.

The mining means 9 is electrically powered from the launch platform 15 by means of an electrical cable (not shown) wound onto a reel (not shown).

With reference to FIG. 1, the launch platform 15 comprises a rigid support frame which includes an overhead continuous shield 16 as a safety measure for operators working on the launch platform 15.

The launch platform 15 comprises, a receiving conveyor 27 (generally known as a "belly conveyor") for receiving coal discharged from the rearmost conveyor unit 13 of the conveying means 11.

The launch platform 15 further comprises a side discharge conveyor 28 for receiving coal from the receiving conveyor 27 and discharging the coal onto a truck loading conveyor 29 and into the surge bin or truck 12 (FIG. 1).

The dimensions of the launch platform 15 are selected so that there is sufficient space for a new conveyor unit 13*a* to be positioned on the launch platform 15 as shown in FIG. 1 and moved into engagement with the rearmost conveyor unit 13 of the conveying means 11 as the mining means 9 and the conveying means 11 move forwardly into the drive.

U.S. Pat. No. 5,609,397 in the name of the applicant herein and which claims priority from Australian provisional applications PL9888 a PM5380 includes a detailed description of the conveying means 11, the launch platform 15, and the driving/controlling means, and we incorporate the disclosure of that patent specification herein by cross-reference.

Figure 2:
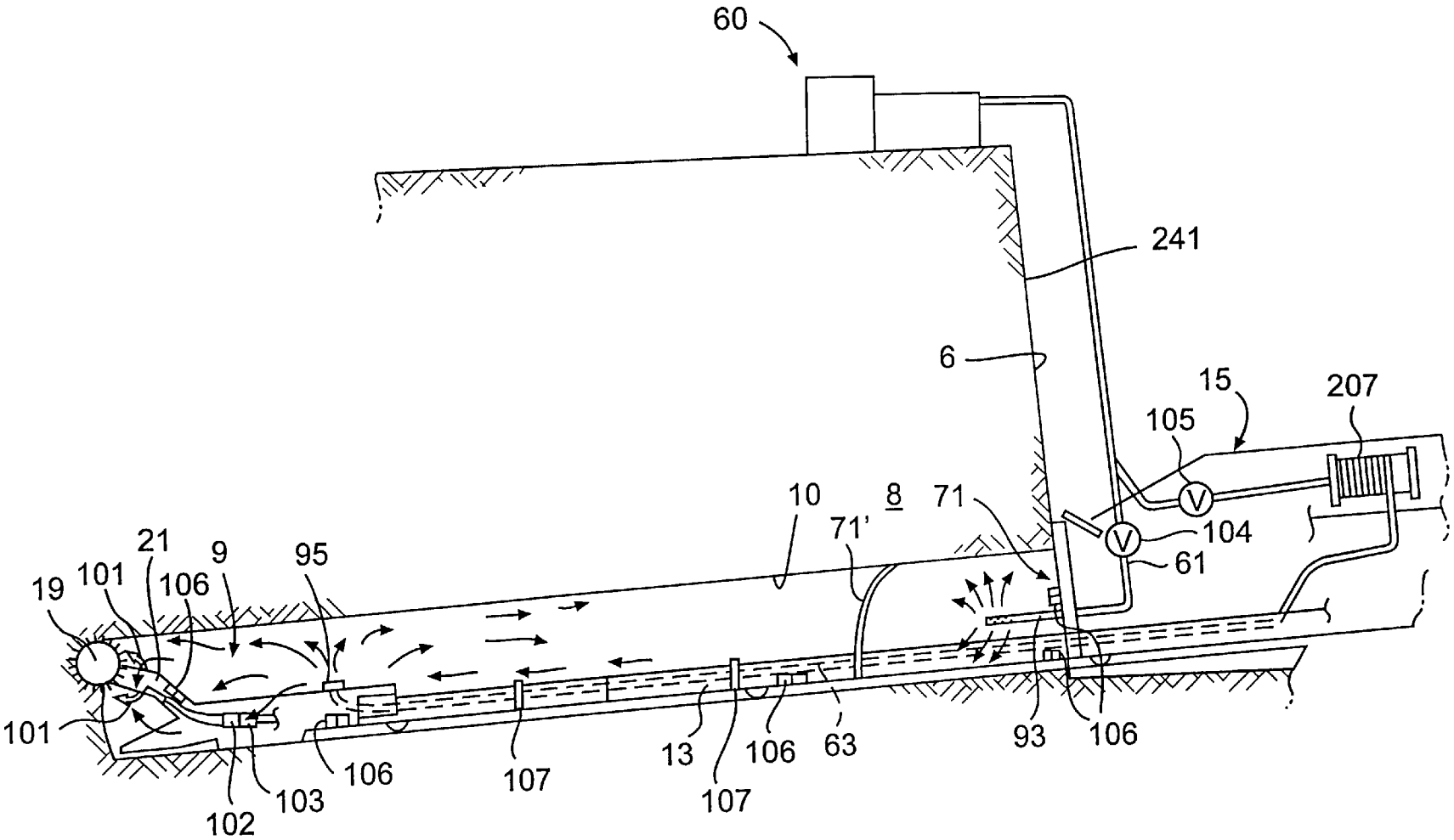
FIG. 2 is a partially perspective side elevation illustrating in more detail the components of the inertization means.

With particular reference to FIG. 2, the inertization means comprises:

(a) a pressure swing absorption (PSA) system 60 (or any other suitable means for generating nitrogen) at a convenient location at the mine 5, such as at the top of the highwall 6 as shown in the figures;

(b) a conduit 61 including a control means (valve) 104 for transferring the nitrogen as required to the entrance of the drive 10;

(c) a conduit 63 including a control means (valve) 105 for transferring the nitrogen as required to the region of the mining means 9; and (d) a barrier means 71 of any suitable form such as a curtain located at the entrance to the drive 10 to restrict the gas flow into and from the drive 10.

With reference to FIG. 2, the conduits 61, 63 terminate in outlets 93, 95 which distribute the nitrogen at the entrance to the drive 10 and at the forward end of the drive 10.

It is noted that the conduit 63 may comprise a plurality of additional outlets (not shown) at spaced intervals along the length of the conduit 63.

It is also noted that sensor means 106 for sampling the concentrations of oxygen and/or methane and/or other flammable gases at the drive entry and in or along the drive 10 are provided.

It is further noted that circulation means 107 located at spaced intervals along the conveying means 13 are provided to mix the outwardly and inwardly flowing gases in the drive 13 to avoid localized build-up of gases and/or dust in the drive 10.

The conduit 63 is connected at the outlet 95 end to the mining means 9 and at the other is wound onto a reel 207 located, by way of example, on the launch platform 15. It can readily be appreciated that with such an arrangement the length of the conduit 63 can extend as required with forward movement of the mining means 9 into the seam 8 to extend the drive 10.

Figure 4:
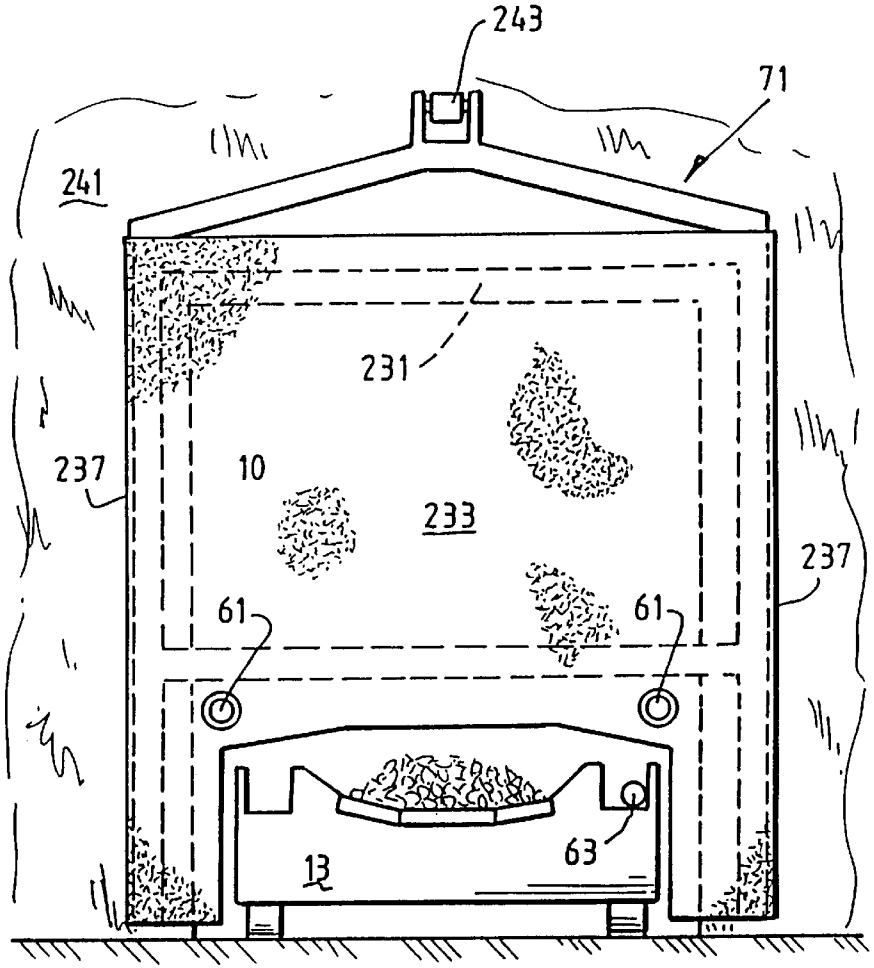
FIG. 4 is a front elevation of the entrance to the drive.
Figure 3:
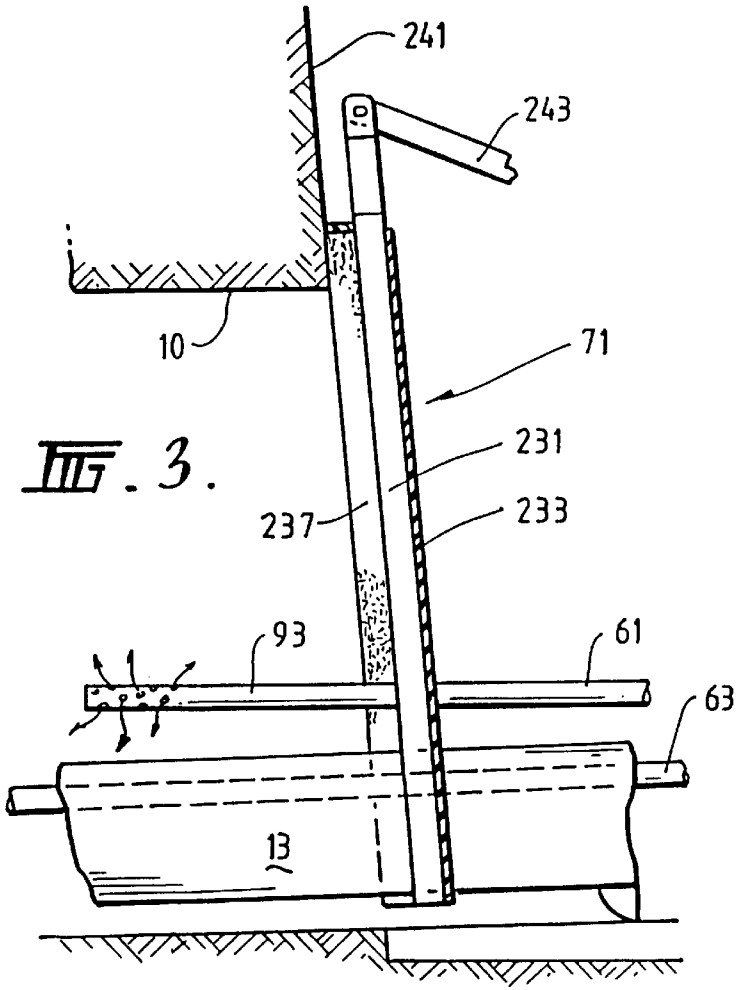
FIG. 3 is a partially sectional side elevation showing in detail the components of the inertization means, at the entrance to the drive.

With reference to FIGS. 3 and 4, the barrier means 71 comprises a steel A-frame 231 (or any other suitably constructed support frame) to which sheets 233 of rubber (or any other suitable barrier material) are secured. The lower section of the barrier means 71 is left open to allow access of the mining means 9 and the conveying means 11. The barrier means 71 further comprises a rubber or other suitable seal 237 at sides and the top of the barrier mean 71 to seal the gap between the barrier means 71 and the exposed face 241 of the highwall 6. The barrier means 71 as shown is supported by an arm 243 from the launch platform 15. An additional barrier means 71' is also possible as shown in FIG. 2.

The precise configuration of this inertization gas delivery system will vary with the particular atmospheric conditions in and around the drive 10 and the equipment operating in the drive 10. Nevertheless, in basic terms, it in preferable that the PSA system be capable of delivering a volume of nitrogen that is greater than the volume of coal being mixed from the drive 10 so as to slightly pressurize the drive 10.

The above-described preferred embodiment enables highwall mining to be conducted in a safe manner.

Many modifications may be made to the preferred embodiments of the present invention described above without departing from the spirit and scope of the present invention.

We claim:

1. A highwall mining system for mining aggregate material from a seam comprising:

(a) a mining means for cutting aggregate material from the seam and thereby forming a drive in the seam;

(b) a conveying means for conveying mined aggregate material from the drive, the conveying means comprising a plurality of modular conveyor units releasably coupled together, each conveyor unit comprising a belt or a chain conveyor; and;

(c) an inertization means for maintaining the concentration of oxygen in the atmosphere in the formed drive lower than the concentration of oxygen required for explosion of methane gas and/or dusts and/or other flammable materials in the drive, the inertization means comprising an inertization gas injection means for injecting an inertization gas into the formed drive at a volume flow rate that is greater than the volume flow rate of mined aggregate material removed from the drive so as to pressurise the drive thereby to create an outward flow of gas from the drive, the inertization gas injection means having an outlet for inertization gas located at the entrance of the drive and adjacent the mining means.

2. The system defined in claim 1 wherein the inertization means further comprises a barrier means to restrict gas flow into and from the drive.

3. The system defined in claim 2 wherein the barrier means is located at the entrance of the drive.

4. The system defined in claim 2 comprising a plurality of the barrier means along the length of the drive.

5. The system defined in claim 1 further comprises a circulation means located adjacent the mining means for circulating the atmosphere at least at the forward end of the drive.

6. The system defined in claim 5 wherein the circulation means is a fan.

7. The system defined in claim 6 wherein the fan is associated with a dust scrubber.

8. The system defined in claim 7 wherein the circulation fan is adjustable to vary the volume of air or gas passed through the dust scrubber in discrete steps and/or infinitely thereby to selectively control the atmosphere in the drive in the region of the mining means.

9. The system defined in claim 8 wherein the circulation fan is arranged to direct air or gas through the dust scrubber.

10. The system defined in claim 1 wherein the inertization gas injection means further comprises an outlet at a spaced interval along the drive between the outlets at the entrance and adjacent the mining means.

11. The system defined in claim 10 wherein the inertization gas injection means further comprises a control means for selectively regulating the volumetric flow rate of the inertization gas through each outlet.

12. The system defined in claim 1 wherein the inertization gas-is selected from one or more of, inert combustion gases, methane, and nitrogen, and mixtures of two or more such gases.

13. The system defined in claim 12 wherein the inertization gas is nitrogen.

14. The system defined in claim 13 wherein the inertization gas injection means comprises, a means for generating nitrogen outside the drive, and a conduit means for transferring the nitrogen into the drive.

15. The system defined in claim 14 wherein the means for generating nitrogen is a pressure swing adsorption means.

16. The system defined in claim 12 wherein the inertization gas is a mixture of nitrogen and inert combustion gases.

17. The system defined in claim 14 wherein the means for generating nitrogen is a membrane system.

18. The system defined in claim 1 further comprising a sensor means for sampling the concentrations of oxygen and/or methane and/or other flammable gases in the drive and/or at the drive entry and/or along the drive.

19. The system defined in claim 18 wherein the mining means is a continuous miner of the type comprising a plurality of cutting picks on a rotatable cutting drum mounted on the end of a boom that is supported for pivotal movement about a horizontal axis.

20. The system defined in claim 19 wherein the mining means comprises water sprays and a dust scrubber or other means for removing dust from the atmosphere in the drive.

21. The system defined in claim 1 wherein the mining means is remotely controlled from outside the drive.

22. The system defined in claim 1 comprising a plurality of the circulation means located at spaced intervals along the conveying means to mix the outwardly and inwardly flowing gases in the drive to avoid localised build-up of gases and/or dusts in the drive.

* * * * *